United States Patent [19]

Kunzmann

[11] 4,237,568

[45] Dec. 9, 1980

[54] APPARATUS AND METHOD FOR THE BINDING OF STACKS OF SHEETS

[75] Inventor: Otto Kunzmann, Neuffen, Fed. Rep. of Germany

[73] Assignee: Bielomatik Leuze GmbH & Co., Neuffen, Fed. Rep. of Germany

[21] Appl. No.: 6,399

[22] Filed: Jan. 25, 1979

[30] Foreign Application Priority Data

Jan. 28, 1978 [DE] Fed. Rep. of Germany ..... 2803775

[51] Int. Cl.[3] ..... B42C 19/00

[52] U.S. Cl. ..... 11/1 R; 140/92.3

[58] Field of Search ..... 11/1 R, 1 A, 1 AC; 140/92.3, 92.7

[56] References Cited

U.S. PATENT DOCUMENTS 2,963,049 12/1960 Biel et al. ..... 140/92.3

2,973,199 2/1961 Biel et al. ..... 140/92.3 X 4,129,913 12/1978 Pfaffle ..... 11/1 A

*Primary Examiner*—Paul A. Bell

*Attorney, Agent, or Firm*—Steele, Gold and Fried

[57] ABSTRACT

Apparatus for binding stacks of sheets has two spiral or comb or the like binding devices located respectively at two binding stations. The stacks to be bound are fed by a conveyor to a distributing station from which the stacks are distributed alternatively to each of the two binding stations by a gripper assembly. The bound stacks are transferred from the binding stations to finishing stations by pivoted arms. After the finishing operation, e.g. the trimming and turning in of the ends of the spiral, the bound stacks are pushed by plungers to form a stack of books or pads at a common discharge station from which the stack is removed by a conveyor belt.

14 Claims, 2 Drawing Figures

APPARATUS AND METHOD FOR THE BINDING OF STACKS OF SHEETS

DESCRIPTION

The invention relates to binding apparatus for the binding of stacks of sheets by means of spiral or comb binders or the like and to binding methods.

German Pat. No. 1,008,708 describes an apparatus for screwing wire spirals into rows of prepared holes in stacks of sheets to form books or pads or the like. The stacks of sheets are gripped by grippers on a wheel and move past a binding station in a step-wise manner. This apparatus operates very reliably, although its maximum possible number of working cycles per minute is limited by the time required for the screwing-in of the spirals, and for the trimming and bending-over of the ends of the spirals. Furthermore, it is of relatively expensive construction, since it requires a large number of grippers or clamping elements for conveying purposes.

An object of the invention is to provide a binding apparatus and method in which it is possible to obtain a high output with relatively low mechanical expense.

According to the present invention, apparatus for the binding of stacks of sheets comprises a respective binding device at each of two binding stations for applying binders to the stacks of sheets, a distributing station for displacing the stacks of sheets alternately to one side or the other into one of the two binding stations respectively, and respective removal means at each binding station for removing the bound stacks of sheets therefrom.

The spiral-screwing operation, or the applying of the comb binding or the like, is now distributed to two stations, so that the frequency of the operating cycles of the entire apparatus can be doubled. With the advantageously possible arrangement of a finishing station which accurately trims and bends over the ends of the spirals or combs, the frequency of the operating cycles can be further increased, since these working operations are now performed in a station disposed downstream of the respective binding station.

Surprisingly, despite the twin arrangement of the binding stations and possibly the finishing stations, the entire apparatus is not more expensive and, in many cases, is even less expensive to construct than the known apparatuses. Furthermore, as a result of a mirror-image twin arrangement of the stations at the two sides of the main axis of conveyance, it is possible to bring the bound stacks of sheets together in such a way that they are placed one on top of the other with adjacent pads or books turned relative to one another by 180°.

One advantage is that the conveying of the stacks of sheets to the entire spiral-screwing and finishing unit can be effected in one plane, so that the stacks of sheets and the individual parts of the apparatus are easily accessible. Relatively few conveying means are required for accurate conveyance, since the large number of clamping elements, required in the known apparatus, is omitted.

The invention includes a method of binding stacks of sheets in which the stacks to be bound are forwardly conveyed to a distributing station from which they are alternately displaced in two substantially opposite directions into two binding stations where they are bound, and in which the bound stacks of sheets are subsequently turned substantially through 90° and are then brought together at a common discharge station.

The invention is further described, by way of example, with reference to the accompanying diagrammatic drawings, in which.

Figure 1:
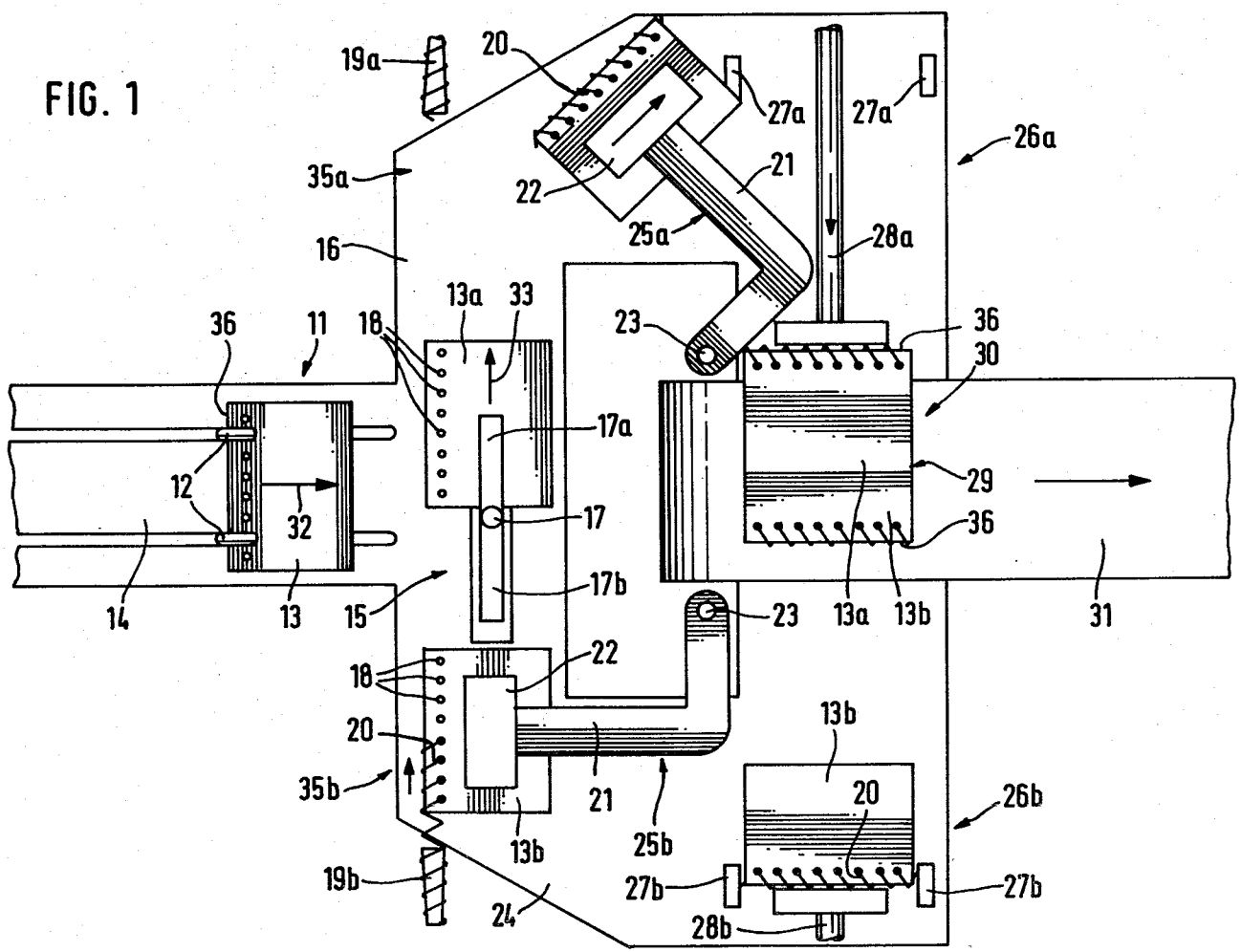
FIG. 1 is a plan view of a book binding apparatus.

The apparatus, illustrated in the drawings, for the binding of layers or stacks of sheets normally forms part of an entire apparatus for the production of pads having a spiral binding.

A forward conveying arrangement 11, having a forward conveying table 14 and grippers 12 moves a stack 13 of sheets synchronously in the direction of the arrow 32, namely towards a distributing station 15 which includes a distributing table 16 and a gripper assembly 17. The gripper is movable in directions transversely of the direction of movement of the stacks of sheets (arrow 33) between two positions which are in each case adjacent to the side edges of the stack 13 of sheets when the latter is pushed onto the distribution table 16. In the present embodiment, the gripper assembly 17, which, alternatively, may be split up into a plurality of individual grippers located one behind the other in the direction of movement and/or adjacent to one another, has two gripper portions 17*a* and 17*b* which can be opened and closed independently of one another and is arranged and controllable such that it alternately displaces the stacks 13 of sheets, synchronously pushed onto the distributing table 16 by the forward conveying arrangement 11, to the right or left transversely of the forward feed direction 32. In the illustrated embodiment, a stack 13*a* of sheets is being displaced to the left in the direction of the arrow 33, whilst the gripper portion 17*b* is open, so that the previously conveyed stack 13*b* of sheets has been released.

When the stack 13*a* of sheets has been fully pushed into a binding station 35*a*, a fresh stack 13 of sheets is pushed into the opened gripper portion 17*b* of the gripper assembly and, after the gripper portion 17*a* has been opened and the gripper porton 17*b* has been closed, the gripper assembly is again displaced to the right.

The parts of the apparatus are of substantially mirror-image construction and, in the drawings, those parts which are located on the left in the forward conveying direction (at the top of the drawing) are designated a, while the parts located on the right in the forward conveying direction (at the bottom of the drawing) are provided with the subscript b.

Thus, a right-hand and a left-hand binding station 35*a*, 35*b* are contiguous to the distributing station 15 and are located virtually at the same level as the distributing table 16.

In the present embodiment, the stacks of sheets are intended for a spiral binder that is to say, each stack of sheets has a punched row 18 of holes along its spine region 36 located rearwardly in the conveying direction, and a spiral 20 can be screwed into the row of holes by means of a spiralling device 19. The spiralling device 19 can, in a conventional manner, comprise a coiling mandrel having a corresponding wire feed. Alternatively, however, it is possible for each binder device to form a comb binding in which two sets of teeth of wire or plastics combs have been previously opened and are pressed through the rows of holes from both sides, so that a binder is produced. The spiralling devices can be readily arranged at the outer ends of the binding stations 35*a*, 35*b*, so as to be easy to observe and readily accessible.

A removal element 25 is provided at each binding station and, in the present embodiment, comprises an angular pivoted arm 21 which is pivotable about an axle 23, and a gripper 22 mounted on the free end of the pivoted arm. If required, this gripper can retain the stack of sheets in the binding station during binding, although other devices could be provided for this purpose. In any case, it is constructed to remove the pad or book of sheets from the binding station after the sheets have been bound. In the present embodiment, and as may be seen in the left-hand (top) portion of the apparatus, the removal element 25 swings the pad or book into a finishing station 26 which can be regarded as an intermediate station.

During this swinging operation, the bound stack of sheets also remains at the same table level which, in the present instance, is in the form of a transfer table 24. Finishing tools 27 are provided in the finishing station and, in the present case, cut the screwed-in spirals to an accurate length and, if necessary, bend over the ends in order to secure the spirals and to eliminate the risk of injury. These finishing tools can pass through the table plane from below.

The finishing stations 26*a*, *b*, are provided with devices for displacing the pads or books to a discharge station 30 at which they are combined to form a stack 29. These devices are in the form of plungers 28*a*, 28*b* and can be actuated alternately and perform a kind of tapping together function in the region of the stack. Alternatively, however, the bringing-together of the pads or books can be effected by means of a belt conveyor which will be described with reference to FIG. 2. The bound pads or books are brought together such that the bound spines 36 are in each case directed towards the side from which the pads or books come. Thus, the spines of the pads or books in the stack 29 are alternatively directed towards each side, so that an even stack is produced. In order to obtain such a stack in known devices, a cross-laying station additionally had to be provided.

The apparatus illustrated in the drawings performs the following method:

As already described, the stacks 12 of sheets arriving on the forward conveying arrangement 11 are alternately displaced to the right and left at the distributing station by its gripper assembly 17, namely preferably at right angles to the forward conveying direction. Alternately, however, angular distribution might be undertaken for specific reasons. While the gripper portion 17*a* of the left (upper) binding station 35*a* is still feeding the stack 13*a* of sheets, the spiral 20 is being screwed into the row 18 of holes in the stack 13*b* of sheets at the other binding station 35*b*.

It will be seen in the left-hand station how a bound stack of sheets provided with a spiral is being swung towards the finishing station 26*a* by the removal element 25*a*, while the plunger 28*a* is still displacing a bound stack 13*a* of sheets, again transversely of the forward conveying direction, inwardly to the stack 29 of pads or books which is located on the discharge station 30. By way of example, the discharge station can comprise a vertically displaceable conveyor belt 31, a gripper conveyor or the like. The next pad or book reaches the finishing station 26*a* only when the plunger 28*a* has been withdrawn again. The spiral is then finished by the finishing tools 27*a*, that is to say it is cut to length and its ends are bent over. These finishing tools can be omitted if turning-in is effected at the binding station, so that the station time in the binding station can be reduced. Although the spiral is already dimensioned to length, it projects slightly at each end. A bound stack 13*b* of sheets, located in its finishing position, can be seen at the finishing station 26*b*.

In the case of binding methods in which there is no need to finish the binder, either the station 26 may be a pure intermediate station, or some other working operation can be performed such as numbering, turning over a cover sheet, or the like. It is also possible to interpose further intermediate stations in which the stacks of sheets run parallel, when working operations are to be performed with a high station time at the stations before the pads or books are again brought together.

Furthermore, it is possible to interpose an alignment station upstream of the distributing station, that is to say in the region of the forward conveying arrangement. By way of example, the sheets in each stack 13 may be pushed at the alignment station on the one hand obliquely from their rectilinear alignment, which they assume from the punching operation, in a transverse direction in conformity with the pitch of the spiral and, on the other hand, to form a hollow rounding in the spine so that the rows of holes match the curvature of the convolutions of the spiral.

This apparatus can be constructed such that it can be converted from a spiral to a comb binder or some other type of binding apparatus merely by changing the binding devices. Although it is preferred to construct the removal elements such that the bound stacks of sheets can be turned through 90° between the binding stations and the intermediate stations, it is also possible to displace the bound stacks of sheets from the binding stations without turning them in the forward conveying direction. In this case, it would also be possible to bring them together by displacing them towards the center, a stack of pads or books then being formed in which all the spines would be located on the same side. This can be important when a stack is not to be formed at the discharge station and the pads or books are to remain all in the same orientation for the purpose of further processing or for packing them individually. However, it is also possible to provide for a pivoting motion between the intermediate station and the discharge station, wherein the discharge station is then selectively formed in a straight or offset position. It is also possible entirely to omit the intermediate station. In this case, the removal elements could deposit the bound stacks of sheets directly in the discharge station.

Figure 2:
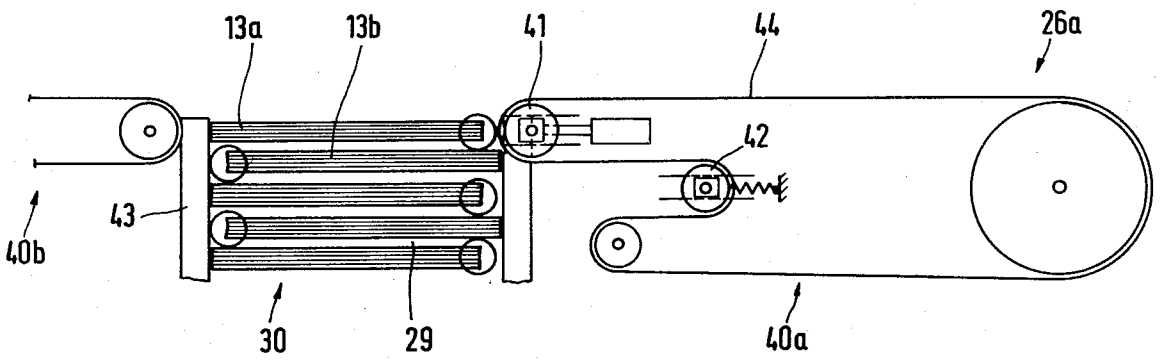
FIG. 2 is a fragmentary section through a variant of the book binding apparatus.

FIG. 2 shows a section through a variant which especially relates to a particularly advantageous form of the conveyance from the finishing station 26*a*, 26*b* to the discharge station 30. The plungers 28 and the associated parts of the table are each replaced by a belt conveyor 40*a*, *b* whose reversal roller 41, directed towards the discharge station 30, is movable towards and away from the discharge station 30, this being rendered possible by the provision of a movable compensating pulley 42. The top run 44 of the belt conveyor 40*a*, *b* is in each case located somewhat higher than the upper edge of the stack of pads or books at the discharge station 30, this feature being obtainable by providing a device for lowering such stack, or by raising the belt conveyor. The article 13 conveyed on the belt conveyor is deposited on the stack 29, and the reversal pulley 41 and the belt then advance towards the stack 29 and the article which has just been deposited thereon and pushes the article against lateral guide bars 43 for the purpose of aligning it with the previously stacked articles. Thus, the belt conveyor has a double function. Its conveying run 44 conveys the articles and its front edge acts as an alignment plunger. Referring to FIG. 2 the right-hand belt conveyor 40*a* is in its aligning position, while the left-hand belt conveyor 40*b* is shown in its retracted position.

I claim:

1. Apparatus for binding stacks of sheets to form pads or books, comprising:

two binding stations;

binding means at each of said binding stations for applying binders to said stacks of sheets;

a distributor station;

means for feeding stacks of unbound sheets to said distributor station;

means at said distributor station, movable back and forth between the binding stations transversely of the feed direction of the stacks of unbound sheets, for distributing said stacks of unbound sheets alterately, to one side or the other into one of said two binding stations; and, respective removal means at each binding station for moving the bound stacks of sheets therefrom to a common central discharge station.

2. Apparatus according to claim 1, further comprising an intermediate station contiguous to each said binding station, said removal means being adapted to place the bound stacks respectively at said intermediate station.

3. Apparatus according to claim 2, further comprising finishing means at each intermediate station for performing at least one finishing operation on the bound stacks of sheets.

4. Apparatus according to claim 3, in which said finishing means are adapted for performing finishing operations on the binding means.

5. Apparatus according to claim 2 in which said removal means each comprise pivotable gripper means for turning the bound stacks of sheets substantially through 90° and deposition them at the intermediate stations.

6. Apparatus according to claim 2 further comprising a common discharge station and means for transferring the bound stacks from the individual intermediate stations to the common discharge station.

7. Apparatus according to claim 6, in which the bound stacks of sheets are located one above the other at the discharge station with their binders alternately staggered through 180°.

8. Apparatus according to claim 6 in which the respective transfer means displace the bound stacks of sheets into the discharge station from opposite directions.

9. Apparatus according to claim 1 in which each binding means comprises a spiralling device arranged in line with the path of movement of the stacks of sheets from the distributing station.

10. Apparatus according to claim 1 in which said stack feeding means comprises forward conveying means on which stacks of sheets to be bound are located with their spine regions, to which the binders are to be applied, directed in a direction opposite to the direction of conveyance to the distributing station.

11. Apparatus according to claim 1 further comprising an aligning station arranged in advance of the distributing station and means at the aligning station for aligning the sheets in each stack appropriately to receive the binders.

12. Apparatus according to claim 1 in which the distributing means comprises stack gripper means which move at half the frequency at which the stacks of sheets are fed to the distributing station.

13. Apparatus according to claim 6 in which each of said transferring means comprises a belt conveyor means having a displaceable reversal roller adjacent the discharge station, whereby the end of the belt conveyor means facing the stack of bound sheets formed at the discharge station is advanceable towards said stack somewhat below the conveying run for the purpose of aligning said stack.

14. A method for binding stacks of sheets, comprising the steps of:

forwardly conveying stacks of unbound sheets to a distributing station;

alternately displacing the forwardly conveyed stacks of sheets transversely of the feed direction, on opposite paths respectively, into two binding stations;

applying binders to the stacks of sheets at the binding stations;

subsequently turning the bound stacks of sheets substantially through 90°, the turning directions in each of the binding stations being opposite the other; and, bringing the so-turned stacks of sheets together at a common discharge station.

* * * * *

UNITED STATES PATENT AND TRADEMARK OFFICE

CERTIFICATE OF CORRECTION

PATENT NO. : 4,237,568

DATED : December 9, 1980

INVENTOR(S) : OTTO KUNZMANN

It is certified that error appears in the above-identified patent and that said Letters Patent are hereby corrected as shown below:

On the title page, column 2, the attorney's name "Gold" should be --Gould--.

On the title page, in the Abstract, at line 5, "alternatively" should be --alternately--.

In the Specification at column 3, lines 49-50, "Alternately" should be --Alternatively--.

In the Claims at column 5, line 43 (Claim 5, line 4), "deposition" should be --depositing--.

In the Claims at column 6, line 24 (Claim 12, line 3), after "stacks of" should be --unbound--.

Signed and Sealed this

*Twenty-first* Day of *April 1981*

[SEAL]

*Attest:*

RENE D. TEGTMEYER

*Attesting Officer*

*Acting Commissioner of Patents and Trademarks*